US007695298B2

(12) United States Patent
Arndt et al.

(10) Patent No.: US 7,695,298 B2
(45) Date of Patent: Apr. 13, 2010

(54) HINGED MODULE COUPLING WITH INTEGRATED CABLE CONNECTION

(75) Inventors: Andrew E. Arndt, Salem, OR (US); Ronald E. Dillon, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 153 days.

(21) Appl. No.: 11/380,703

(22) Filed: Apr. 28, 2006

(65) Prior Publication Data

US 2007/0254495 A1 Nov. 1, 2007

(51) Int. Cl.
*H01R 3/00* (2006.01)

(52) U.S. Cl. ..... 439/165; 439/31; 439/248

(58) Field of Classification Search ..... 439/165, 439/31, 247, 248; 358/474, 482
See application file for complete search history.

(56) References Cited

U.S. PATENT DOCUMENTS

| | | | | | |
|---|---|---|---|---|---|
| 5,166,893 | A | * | 11/1992 | Hosoi | 361/681 |
| 5,174,761 | A | * | 12/1992 | Kodaira | 439/31 |
| 5,228,865 | A | * | 7/1993 | Douty et al. | 439/247 |
| 5,253,139 | A | * | 10/1993 | Satou | 361/681 |
| 5,498,165 | A | * | 3/1996 | Tseng | 439/31 |
| 5,622,511 | A | * | 4/1997 | Jarrett | 439/248 |
| 5,751,544 | A | * | 5/1998 | Song | 361/681 |
| 5,951,312 | A | * | 9/1999 | Horng | 439/165 |
| 6,053,496 | A | | 4/2000 | Nunes | |
| 6,163,452 | A | * | 12/2000 | O'Neal et al. | 361/681 |
| 6,234,817 | B1 | * | 5/2001 | Hwang | 439/247 |
| 6,484,016 | B1 | * | 11/2002 | Cheon | 455/90.1 |
| 6,984,144 | B1 | | 1/2006 | Nelson et al. | |

* cited by examiner

*Primary Examiner*—Xuong M Chung-Trans
(74) *Attorney, Agent, or Firm*—Marger Johnson & McCollom, P.C.

(57) ABSTRACT

A hinge includes a first housing, a second housing mechanically coupled to the first housing, a cam connected to one of the first housing and the second housing, a first connector mechanically coupled to the first housing, a second connector, and a cable coupled to the first connector and the second connector.

18 Claims, 3 Drawing Sheets

FIG. 1
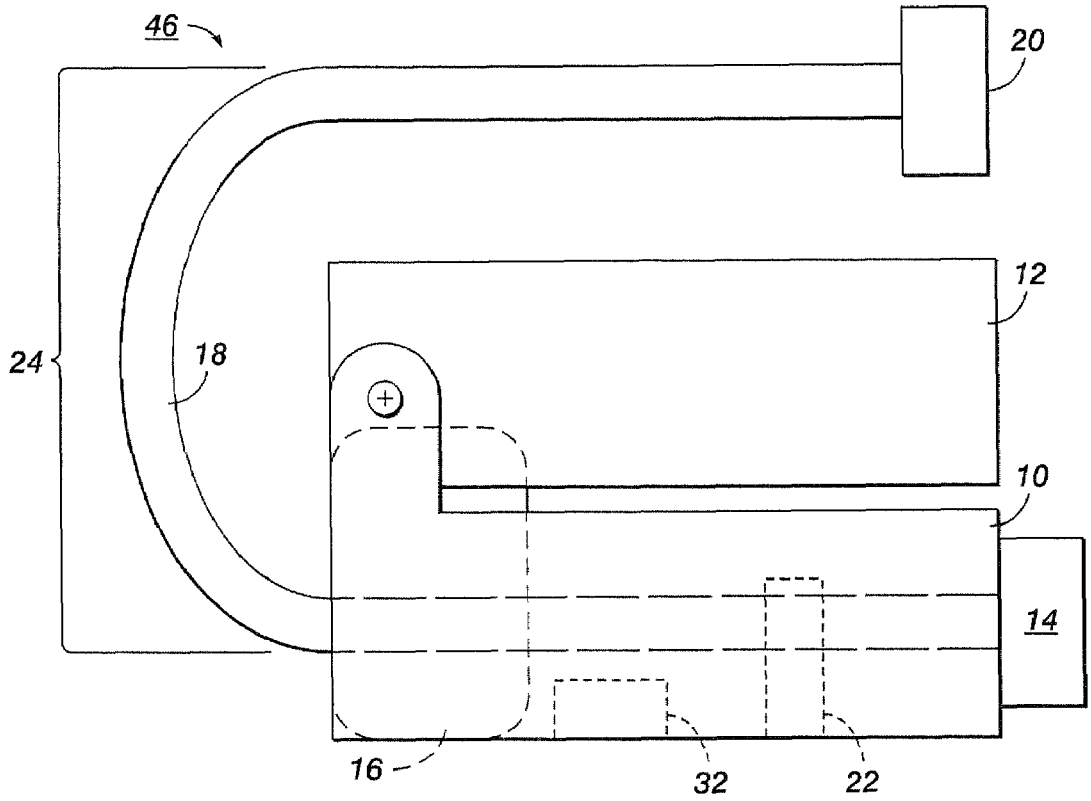
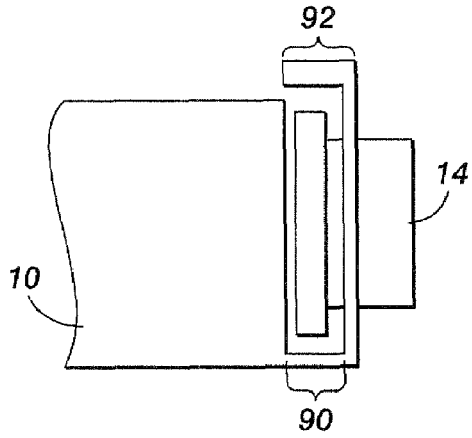
FIG. 2

HINGED MODULE COUPLING WITH INTEGRATED CABLE CONNECTION

BACKGROUND

An imaging product, such as a multi function printer, may include modular devices. For example, an imaging product may have modules such as an image input terminal (ITT) and an image output terminal (TOT). An ITT may be mounted on an TOT to connect the modules together, yet still allow for relative motion between the two. A cable may connect an IIT with an TOT for both power and communications. Since these devices are modular devices, such a cable may be connected by an end user installing a new modular device such as a new ITT.

However, because of size constraints and other factors, a connector for a cable on a modular device may be difficult to install, particularly by the end user. Such difficulties lead to increased intermittent problems or failures due to poor connections, increased service calls, and a decrease in consumer confidence in both the imaging product and the manufacturer. Furthermore, any problems from poor or intermittent connections are exacerbated by the relative motion of modules of the imaging product.

SUMMARY

An embodiment includes a hinge including a first housing, a second housing mechanically coupled to the first housing, a cam connected to one of the first housing and the second housing, a first connector mechanically coupled to the first housing, a second connector, and a cable coupled to the first connector and the second connector.

A further embodiment includes an imaging product including a first module having at least one first module connector, a second module, and at least one hinge to mechanically couple the first module to the second module. Each hinge includes a first housing, a second housing mechanically coupled to the first housing, a cam connected to one of the first housing and the second housing, a first hinge connector mechanically coupled to the first housing, a second hinge connector, and a cable coupled to the first connector and the second connector. When the first module and the second module are mechanically coupled by the hinge, at least one first hinge connector connects with an associated first module connector.

Another embodiment includes a method of forming an electrical connection between a first module and a second module of an imaging product, including aligning a hinge of the second module with a receptacle of the first module, and inserting the hinge into the receptacle of the first module such that a connector on the hinge connects with a connector on the first module.

BRIEF DESCRIPTION OF THE DRAWINGS

FIG. 1 is a diagram of an embodiment of a hinge having an integrated cable connection;

FIG. 2 is an expanded view of an end of a first housing of the hinge of FIG. 1;

DETAILED DESCRIPTION

Figure 3:
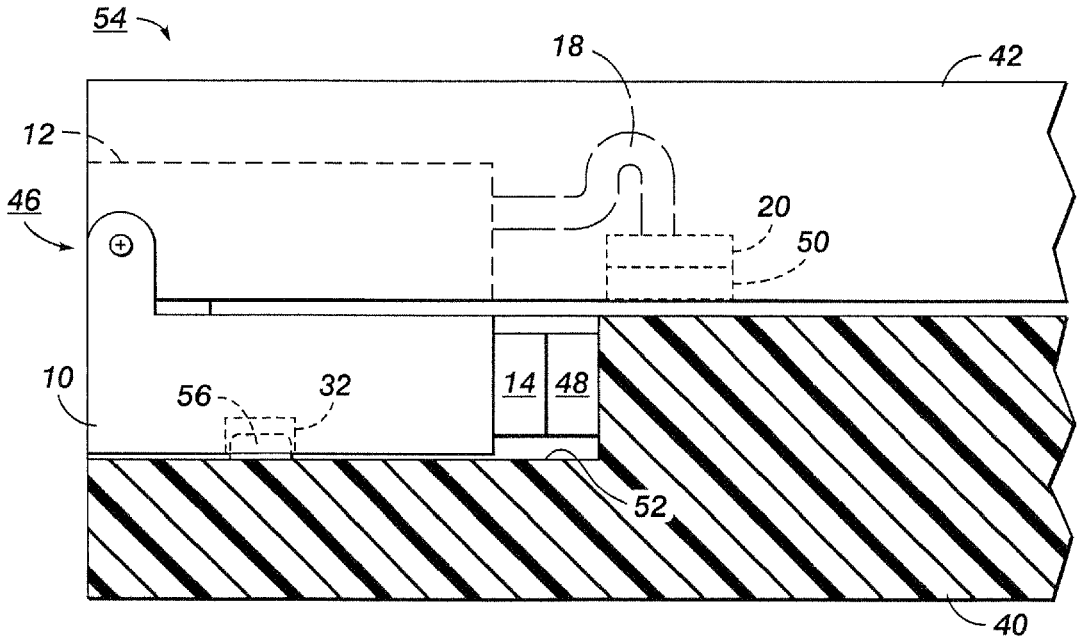
FIG. 3 is a diagram of an embodiment of an imaging product coupled with a hinge having an integrated cable connection.

FIG. 1 is a diagram of an embodiment of a hinge 46 having an integrated cable connection. The hinge 46 includes a first housing 10 and a second housing 12. The first housing 10 is mechanically coupled to the second housing 12. A cam 16 is connected to the first housing 10 or the second housing 12. For this discussion, the cam 16 will be referred to as connected to the first housing 10, although one of ordinary skill in the art will understand that the cam 16 may be connected to the second housing 12. In other embodiments, the cam 16 may be rigidly connected to the first housing 10. As used in this discussion, rigidly connected means connected such that the relative motion of the connected parts is substantially limited. One of ordinary skill in the art will understand that although two parts may be designed to have little to no relative motion, some relative motion is will exist. The term rigidly connected includes such relative motion. For example, the cam 16 and the first housing 10 may be separate parts that are rigidly connected together during assembly. Alternatively, the cam 16 and the first housing 10 may be one contiguous part, with the cam 16 being a portion of the first housing 10.

A first connector 14 is mechanically coupled to the first housing 10. As used in this discussion, mechanically coupled means coupled such that the range of relative motion between the coupled parts is limited. Although mechanically coupled is distinguished from rigidly coupled as described above, mechanically coupled both includes and extends beyond rigidly coupled. As such, mechanically coupled parts may have a range of relative motion such that the parts would not be considered fixed to one another. In the hinge 46 of FIG. 1, the first connector 14 is mechanically coupled to an end of the first housing 10.

FIG. 2 is an expanded view of an end of a first housing of the hinge of FIG. 1. The first housing 10 may include a slot 90 in which the first connector 14 is disposed. At least one tab 92 may mechanically capture the first connector 14, mechanically coupling it to the first housing 10. When mechanically coupled to the first housing 10, the first connector 14 may still move over a limited range. Thus, although mechanically coupled to the first housing 10, the first connector may be mechanically floating. For example, the first connector 14 may still have a range of motion in a plane perpendicular to an insertion direction of the first connector 14. Alternatively, the first connector 14 may be rigidly coupled to the first housing Referring again to FIG. 1, the first connector 14 may be a blind mate connector. A blind mate connector is a connector designed such that within a mechanical tolerance, the blind mate connector and its mate need not be aligned. The mechanical tolerance for alignment of a blind mate connector is generally greater than that of other types of connectors. Such capability may be implemented within the connector itself.

The first housing 10 may include alignment surfaces to align the first connector 14 with a connector within a hinge receptacle (for example, a hinge receptacle 52 of FIG. 3). Connectors inherently allow for some misalignment during connection. However, some connectors allow for more misalignment than others. For example, a blind mate connector as described above may have features or surfaces that allow for a greater amount of misalignment than other connectors. A connector that does not allow for such an amount of misalignment with its mate may still be used. The alignment surfaces on the first housing 10 aid in aligning the first connector 14 with its mate such that the connectors are aligned within the tolerance of the first connector 14.

A cable 18 is coupled to the first connector 14 and a second connector 20. A portion of the cable 18 may be routed though the cam 16. Alternatively, a portion of the cable 18 may pass beside the cam 16. The cable 18 may form electrical connections between contacts of the first connector 14 and the second connector 20. Although such an assembly of the cable 18, the first connector 14, and the second connector 20 may be used to route electrical signals, one of ordinary skill in the art will understand that the assembly may be used to route other types of signals. For example, a mechanical linkage may be formed through the cable 18. Alternatively, an optical signal may pass through the cable 18. Furthermore, such signals and connections are not limited to any one type in one cable 18. For example, an electrical signal and an optical signal may be routed through the same cable 18 through the appropriate media.

Although the second connector 20 is shown not connected to the second housing 12, the second connector 20 may be either disconnected or connected to the second housing as desired. For example, the second connector 20 may be rigidly coupled to the second housing 12. Alternatively, the second connector 20 may be mechanically coupled to the second housing 12 through the cable 18 so that a connection formed using the second connector 20 may be formed some distance away from the second housing 12.

The hinge may include a strain relief. An example is a strain relief 22. The strain relief 22 may be coupled to the first housing 10. The cable 18 may pass through the strain relief 22, coupling a portion of the cable 18 to the first housing. Thus, mechanical stress on the cable 18 on the side of the cable 18 including the second connector 20 will have a reduced effect on the first connector 14.

Alternatively, the strain relief may include a strain relief portion of the cable 18. The strain relief portion of the cable 18 may be a length 24 of the cable 18. Thus, when the hinge 46 is moved though its full range of motion, the cable 18 retains an amount of slack.

Furthermore, the cam 16 may form a strain relief. As described above, the cable 18 is routed through the cam 16. The cable 18 may be rigidly coupled to the cam 16. Such a rigid connection may also serve as a strain relief, isolating the first connector 14 and portions of the cable 18 from mechanical stress associated with movement of the hinge 46.

The first housing 10 may include an engagement surface 32 used to mechanically capture the hinge 46 if the hinge 46 is inserted into a hinge receptacle. For example, the engagement surface 32 may include a recessed portion of the first housing 10. When inserted into the hinge receptacle, a catch in the hinge 46 receptacle may engage with the recessed portion. Thus, the recessed portion of the first housing 10 as an engagement surface is used to mechanically capture the hinge 46 in the hinge receptacle. Alternatively, the engagement surface 32 may be part of the cam 16

Some hinges 46 may include a mass nullifying structure. Such a structure may include the cam 16 that is stationary relative to one of the housings. The cable 18 may be routed through the cam 16 without disturbing the mass nullifying structure, even though a complex mechanism may be creating the mass nullifying effect. Thus, a carefully balanced hinge cam weight counter-force operation is not affected. Furthermore, by routing the cable 18 through the cam 16, cable routing in the scanner hinge area is achieved without affecting any functional hinge geometry. Furthermore, cam 16 parts may be modified from existing designs to route the cable 18 through the cam 16. Such changes do not make the cam parts any more difficult to manufacture.

In some portions of this discussion, a connector of the hinge 46, such as a first connector 14, may be referred to as a hinge connector to distinguish the connector of the hinge from other connectors. For example, a first connector 14 may be referred to as a first hinge connector 14.

FIG. 3 is a diagram of an embodiment of an imaging product coupled with a hinge having an integrated cable connection. An imaging product 54 may be any device that prints, scans, copies, faxes, or otherwise manipulates an image. The imaging product 54 includes a first module 40 and a second module 42. A module, such as the first module 40 or the second module 42, may be any type of module for use in an imaging product 54. For example, the first module 40 may be a printer and the second module 42 may be a scanner. Thus, the combination of the first module 40 and the second module 42 may form a photocopier.

The first module 40 is mechanically coupled to the second module 42 by a hinge 46. The hinge 46 allows for a range of motion between the first module 40 and the second module 42. The hinge 46 may be a hinge 46 as described above. Since the cable 18 of the hinge 46 is routed through the hinge 46, a connection between the first module 40 and the second module 42 is routed through the hinge, rather than outside of the hinge as a separately made connection. Furthermore, since the cable 18 may be routed through the hinge, and not outside of the modules, the cable 18 may be hidden from view. Thus, the appearance of the imaging product 54 is improved.

As described above, the hinge 46 may allow connections using a variety of media, allowing the first module 40 and the second module 42 to communicate over that variety of media. Thus, the hinge 46 provides connections between the first module 40 and the second module 42, such as electrical connections for power supplies and data signals.

When the hinge 46 is used in an imaging product 54, a screw secured connector typically secured by the end user is eliminated. Furthermore, the cable 18 is routed inside of the module envelope. Thus, unsightly cables are routed within the modules, improving the aesthetics of the MFD and reducing or eliminating any vulnerability to snagging.

Although one hinge 46 has been illustrated, more than one hinge 46 may be used as desired. For example, a second hinge 46 may be used. Thus, two cables are available for connections between the first module 40 and the second module 42. In addition, different types of connections may be formed through different hinges. For example, the first hinge 46 may have connections for electrical data signals and the second hinge 46 may have connections for electrical power supplies. However, such capability does not mean that differing signal types may not be routed through a cable of a single hinge 46. For example, both power supplies and data signals may be routed through the same cable of the same hinge 46.

The first module 40 has a first module connector 48. The first module connector 48 may be located within the hinge receptacle 52. The first module connector 48 connects with the first hinge connector 14 of the hinge 46 when the hinge is installed in the first module 40. If additional hinges 46 are used as described above, the first module 40 may have additional first module connectors 48 to connect with the first hinge connectors 14 of the hinge 46.

The second module 42 has a second module connector 50. The second module connector 50 connects with the second hinge connector 20. Similar to the first module 40 described above, if multiple hinges 46 are used, the second module 42 may have multiple second module connectors 50 to connect with the multiple second hinge connectors 20.

The first module 40 may have alignment surfaces to guide the first housing 10 of the hinge 46 into the first module 40 during assembly. The alignment surfaces may be part of the hinge receptacle 52. The first hinge connector 14 is mounted on the first housing 10 so that position and guidance features of the hinge 46 and the first module 40 align the connectors and ensure predictable engagement based on the mechanical tolerance of the first module connector 48 and the first hinge connector 14.

As described above, blind mate connectors may be used for the first hinge connector 14. Similarly, blind mate connectors may be used for the first module connector 48. As a result, there is an amount of misalignment that may be tolerated by the connectors and still achieve a reliable connection. In such a case, the alignment features of the first module 40 and the hinge 46 may be used only to place the connectors in a relative position to be within mechanical tolerances to ensure connection.

Alternatively, if other connectors not designed as blind mate connectors are used, the alignment features may be used to align the connectors, such that the connectors are aligned within the smaller tolerance required by the connectors. Regardless, a proper and reliable joining of the connectors is made without additional attention or effort by the end user as the second module 42 is mated and locked to the first module 40.

Furthermore, similar to the first hinge connector 14 described above, the first module connector 48 may be mechanically floating relative to the first module 40. As a result, the connection between the first hinge connector 14 and the first module connector 48 may tolerate a greater misalignment, particularly if the first hinge connector 14 is rigidly coupled to the first housing 10.

The hinge 46 may be rigidly fixed to the second module 42. In other words, the hinge 46 may be part of the second module 42. The hinge 46 may be attached to the second module 42 through the second housing 12 of the hinge 46. For example, the hinge 46 may be mounted to the second module 42 by screws or other fasteners or fastening techniques. In addition, the second housing 12 may be an integral part of second module 42. For example, a housing (not shown) of the second module 42 may include a portion that is the second housing 12. Thus, when the first housing 10 is attached to the second housing 12, the completed hinge 46 would become part of the second module 42.

When the hinge 46 is installed in the second module 42, the second hinge connector 20 of the hinge 46 may be connected to the second module connector 50. As described above, the second connector 20 need not be directly mechanically coupled to the second housing 12. Thus, when the hinge is installed in the second module 42, the connection between the second hinge connector 20 and the second module connector 50 need not be made immediately adjacent to the second housing 12. For example, a sufficient length of cable 18 may allow for the connection to be made a distance away from the location of the second housing 12 within the second module 42. Alternatively, the second hinge connector 20 may be mounted on the second housing 12 such that when the hinge 46 is mounted on the second module 42, a connection is made between the second hinge connector 20 and the second module connector 50.

When the hinge 46 is inserted into the hinge receptacle 52, the hinge 46 may be mechanically captured in the hinge receptacle 52. For example, the hinge receptacle 52 may include a catch to engage with an engagement surface 32 on the hinge 46. Thus, the catch 56 may mechanically capture the hinge 46 within the first module 40.

Although when describing an imaging product 54, hinges 46 having a first hinge connector 14 have been described as matching up to first module connectors 48, every first hinge connector 14 need not have a matching first module connector 48. Similarly, every first module connector 48 need not have a matching first hinge connector 14. For example, consider a first module 40 having two first module connectors 48 within two hinge receptacles 52 as first module 40A and another first module 40 having only one first module connector 48 within one of two hinge receptacles 52 as first module 40B. Similarly, consider a second module 42 having two first hinge connectors 48 on two hinges 46 as second module 42A and another second module 40 having only one first hinge connector 48 on one of two hinges 46 as second module 42B. If first module 40A is connected to second module 42A, or first module 40B is connected to second module 42B, each module has a matching number of connectors as described above. However, if first module 40A is connected to second module 42B, there is one more first module connector 48 than there are matching first hinge connectors 14. Thus, a connection is formed through only one of the hinges 46. As a result, some functionality available in the first module 40A may not be available, however, all functionality available in the second module 42B may be available. Similarly, if the first module 40B is connected to the second module 42A, some functionality available in the second module 42A may not be available, however, all functionality available in the first module 40B may be available. Thus, any given first module 40 or second module 42 may be capable of connecting with a variety of modules having various connector combinations.

Figure 4:
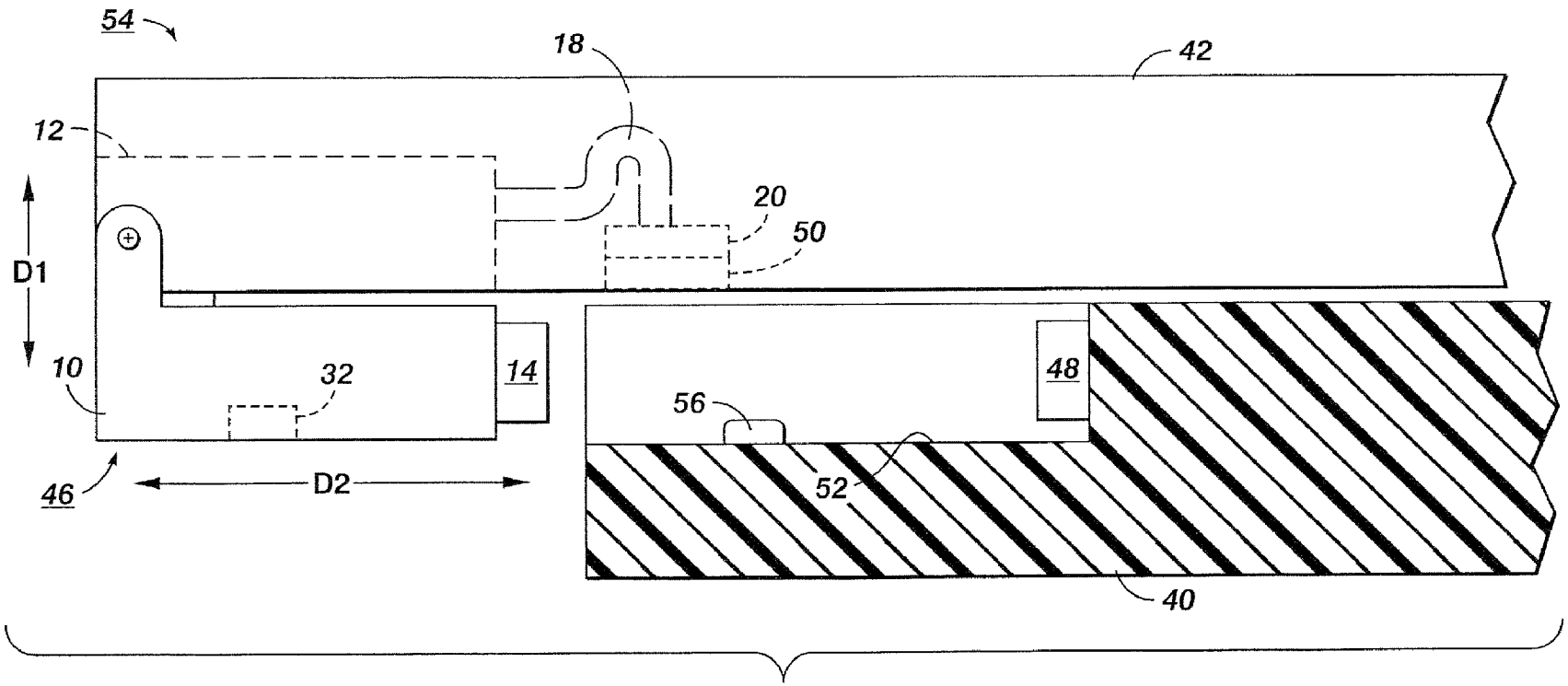
FIG. 4 is a diagram illustrating a method of coupling modules of an imaging product using a hinge with an integrated cable connection.

FIG. 4 is a diagram illustrating a method of coupling modules of an imaging product using a hinge with an integrated cable connection. As shown in FIG. 4, a second module 42 with a hinge 46 is aligned with a hinge receptacle 52 of the first module. Such alignment may include motion along a direction D1. When aligned, the second module 42 is moved along a direction D2 such that the hinge 46 is inserted into the hinge receptacle 52. When inserted, a first hinge connector 14 on the hinge 46 connects with a first module connector 48.

The above described alignment and insertion may be performed by an end user of the product. As a result, a connection, particularly an electrical connection, may be made between the first module 40 and the second module 42 by the assembly process without making a separate cable connection. Because the end user is no longer required to make a connection separate from the assembly process, the potential for poor or intermittent connections between the first module 40 and the second module 42 is reduced. Connections with consistent quality may be formed merely by assembling the modules.

Although a hinge has been shown with a connector on one end such that when inserted into the receptacle, a connection is made to the first module, one of ordinary skill in the art will understand that other locations for the first hinge connector and other insertion techniques may be used. For example, if the first hinge connector is mounted on a side of the first housing 10 opposite the second module 42, the second module 42 may be lowered on to the receptacle such that the insertion force for inserting the would be in the direction D1 of FIG. 4.

It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A hinge comprising:

a first housing having a first end and a second end opposite the first end, the first housing including a slot disposed at the first end;

a second housing a mechanically coupled to the first housing at the second end and configured to rotate about an axis of rotation at the second end of the first housing;

a cam connected to one of the first housing and the second housing;

a first connector mechanically coupled to the first end of the first housing and mechanically floating within the slot at the first end of the first housing;

a second connector;

a cable coupled to the first connector and the second connector; and an engagement surface to mechanically capture the hinge in a hinge receptacle having a receptacle engagement surface such that an engagement of the engagement surface and the receptacle engagement surface mechanically captures the hinge in the hinge receptacle;

wherein the cable between the first connector and the second connector is routed around of the axis of rotation.

2. The hinge of claim 1, the cable further comprising a strain relief portion such that the cable retains an amount of slack throughout a full range of motion of the hinge.

3. The hinge of claim 1, the cable further comprising a portion of the cable routed through the cam.

4. The hinge of claim 1, further comprising a strain relief mechanically coupling a portion of the cable between the cam and the first connector to the first housing.

5. The hinge of claim 1, the first housing further comprising at least one tab, the at least one tab mechanically capturing the first connector to the first housing in the slot.

6. The hinge of claim 1, the second connector rigidly fixed to the second housing.

7. The hinge of claim 1, the first housing further comprising an alignment surface to align the first connector with a connector within a hinge receptacle.

8. The hinge of claim 1, the first connector comprising a blind mate connector.

9. The hinge of claim 1, wherein the first connector is constrained within the slot such that a range of motion of the first connector in a plane substantially perpendicular to an insertion direction of the first connector is greater than a range of motion of the first connector in the insertion direction.

10. The hinge of claim 1, wherein the cable between the first connector and the second connector is disposed outside of the second housing.

11. An imaging product comprising:

a printer having at least one printer connector;

a scanner;

at least one hinge to mechanically couple the printer to the scanner, each hinge including:

a first housing having a first end and a second end opposite the first end, the first housing including a slot disposed at the first end;

a second housing mechanically coupled to the first housing at the second end and configured to rotate about an axis of rotation at the second end of the first housing, the second housing rigidly coupled to the scanner;

a cam rigidly fixed to one of the first housing and the second housing;

a first hinge connector mechanically coupled to the first end of the first housing and mechanically floating within the slot at the first end of the first housing;

a second hinge connector; and a cable coupled to the first connector and the second connector, routed through the cam such that the cable between the first connector and the second connector is routed around the axis of rotation and rigidly fixed to the cam;

wherein when the printer and the scanner are mechanically coupled by the hinge, at least one first hinge connector connects with an associated printer connector;

the printer further comprises at least one hinge receptacle, each hinge receptacle including a receptacle engagement surface to mechanically capture an associated hinge; and each hinge further comprises a hinge engagement surface to mechanically capture the hinge in an associated hinge receptacle.

12. The imaging product of claim 11, signals and power supplies are supplied to and from the printer and the scanner through the cable of the hinge.

13. The imaging product of claim 11, wherein:

each hinge receptacle including an associated printer connector, and a receptacle alignment surface; and each hinge further comprises a hinge alignment surface to align the first hinge connector with the printer connector of an associated hinge receptacle.

14. The imaging product of claim 11, wherein:

the scanner further comprises a scanner connector; and the second hinge connector is connected to the scanner connector.

15. The imaging product of claim 11, wherein for the at least one hinge, the first hinge connector and the associated first module connector are configured and arranged such that the first hinge connector and the associated first module connector connect as the hinge engagement surface engages the receptacle engagement surface of the associated hinge receptacle.

16. The imaging product of claim 11, wherein:

for each hinge, the hinge engagement surface includes a recessed region of the first housing; ant for each hinge receptacle, the receptacle engagement surface includes a catch configured to mate with the recessed region of a corresponding hinge.

17. A method of forming an electrical connection between a first module and a second module of an imaging product, the second module including a hinge including:

a first housing having a first end and a second end opposite the first end, the first housing including a slot disposed at the first end;

a second housing mechanically coupled to the first housing at the second end and configured to rotate about an axis of rotation at the second end of the first housing, the second housing rigidly coupled to the second module;

a first connector mechanically coupled to the first end of the first housing and mechanically floating within the slot at the first end of the first housing;

a second connector; and a cable coupled to the first connector and the second connector and routed around of the axis of rotation;

the method comprising:

aligning the first housing of the hinge of the second module with a receptacle of the first module; and inserting the first housing into the receptacle of the first module to engage a hinge engagement surface of the first housing with a receptacle engagement surface of the receptacle such that the connector of the first housing connects with a connector on the first module as the hinge engagement surface of the first housing and the receptacle engagement surface of the receptacle are engaged;

wherein the engagement of the hinge engagement surface of the first housing and the receptacle engagement surface of the receptacle mechanically capture the hinge in the first module.

18. The method of claim 17, wherein:

the second connector is mechanically coupled to the hinge; and the method further comprises coupling the second connector to the second module.

* * * * *